US010813484B2

(12) United States Patent
Pivirotto et al.

(10) Patent No.: US 10,813,484 B2
(45) Date of Patent: Oct. 27, 2020

(54) SWIGSAFE PARTY TUMBLER

(71) Applicant: Thomas Point Enterprises, LLC, Washington, DC (US)

(72) Inventors: Brenda Brophy Pivirotto, Washington, DC (US); Olivia Pivirotto, Washington, DC (US)

(73) Assignee: Thomas Point Enterprises, LLC, Washington, DC (US)

( * ) Notice: Subject to any disclaimer, the term of this patent is extended or adjusted under 35 U.S.C. 154(b) by 67 days.

(21) Appl. No.: 16/049,157

(22) Filed: Jul. 30, 2018

(65) Prior Publication Data

US 2019/0038054 A1 Feb. 7, 2019

Related U.S. Application Data

(60) Provisional application No. 62/539,816, filed on Aug. 1, 2017.

(51) Int. Cl.

| | |
|---|---|
| ***A47G 19/22*** | (2006.01) |
| ***B65D 43/02*** | (2006.01) |
| ***B65D 51/24*** | (2006.01) |
| ***B65D 47/12*** | (2006.01) |

(Continued)

(52) U.S. Cl.

CPC ..... *A47G 19/2227* (2013.01); *B65D 25/56* (2013.01); *B65D 43/0214* (2013.01); *B65D 43/0231* (2013.01); *B65D 47/0895* (2013.01); *B65D 47/12* (2013.01); *B65D 51/242* (2013.01); *B65D 51/245* (2013.01); *B65D 2203/04* (2013.01); *B65D 2543/00046* (2013.01); *B65D 2543/00092* (2013.01); *B65D 2543/00296* (2013.01); *B65D 2543/00527* (2013.01); *B65D 2543/00537* (2013.01); *B65D 2543/00972* (2013.01)

(58) Field of Classification Search

CPC ..... B65D 25/56; B65D 43/0214; B65D 43/0231; B65D 47/0895; B65D 51/242; B65D 51/245; B65D 47/12; B65D 2203/04; B65D 2543/00046; B65D 2543/00296; A47G 19/2227

USPC ..... 206/459.5, 459.1; 220/810

See application file for complete search history.

(56) References Cited

U.S. PATENT DOCUMENTS 2,010,534 A * 8/1935 Collins ..... A47J 43/27 220/568

2,882,947 A * 4/1959 Close ..... B65D 47/0895 220/254.3

(Continued)

OTHER PUBLICATIONS

Ace Mart "Libbey 1639/1918M 16 oz Mixing Beverage Glass w/ Measurements" Wayback Machine dated Dec. 19, 2016 https://web.archive.org/web/20161219053126/https://www.acemart.com/beverage/bar-supplies/bar-shakers/libbey-1639/1918m-16-oz-mixing-beverage-glass-with-measurements/LIB1639/1918M (Year: 2016).*

*Primary Examiner* — Chun Hoi Cheung

(74) *Attorney, Agent, or Firm* — Oblon, McClelland, Maier & Neustadt, L.L.P.

(57) ABSTRACT

A container for liquid includes a tumbler, wherein the tumbler includes a plurality of visual aids. Additionally, the container includes a lid detachably secured to the tumbler, wherein the lid includes a swing arm flap configured to be secured in an open or closed position, and an opening in a body of the lid configured to receive a portion of the swing arm flap in the closed position to seal the opening in the body of the lid.

17 Claims, 17 Drawing Sheets

(51) Int. Cl.
*B65D 47/08* (2006.01)
*B65D 25/56* (2006.01)

(56) References Cited

U.S. PATENT DOCUMENTS 3,181,746 A * 5/1965 Tupper ..... B65D 47/0895 222/545
4,420,076 A * 12/1983 Beveridge ..... A45C 11/24 206/37
5,071,060 A * 12/1991 DeFelice ..... B65D 1/265 220/675
5,358,770 A * 10/1994 Evans ..... B44C 5/00 40/310
6,615,517 B2 * 9/2003 King ..... G09F 3/00 40/324
7,975,868 B1 * 7/2011 Flies ..... B65D 1/24 215/12.1
2003/0052126 A1 * 3/2003 Zettle ..... B65D 43/0212 220/254.3
2003/0230019 A1 * 12/2003 Olivera ..... G09F 3/00 40/665
2007/0175931 A1 * 8/2007 Leoncavallo ..... B65D 47/0895 222/556
2008/0210586 A1 * 9/2008 Didio ..... G09F 3/005 206/457
2009/0178313 A1 * 7/2009 McManigal ..... G09F 3/00 40/310
2010/0308006 A1 * 12/2010 Walker-Smith ..... A45F 3/16 215/305
2011/0024320 A1 * 2/2011 Roman ..... A47J 43/27 206/459.5
2013/0081970 A1 * 4/2013 Dietvorst ..... B65D 25/22 206/494
2014/0360908 A1 * 12/2014 Sorensen ..... B65D 21/0228 206/501
2015/0360831 A1 * 12/2015 Backert ..... A47G 23/16 222/109
2016/0376061 A1 * 12/2016 Shirley ..... B65D 1/02 215/228
2017/0225850 A1 * 8/2017 Sorensen ..... B65D 47/0895
2018/0362225 A1 * 12/2018 Davies ..... A45F 3/18

* cited by examiner

SWIGSAFE PARTY TUMBLER

CROSS-REFERENCE TO RELATED APPLICATION

This application claims the benefit of U.S. Provisional Application No. 62/539,816, filed Aug. 1, 2017, which is incorporated herein by reference in its entirety.

BACKGROUND

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly or impliedly admitted as prior art against the present invention.

It is unfortunate, but it has become all too commonplace to hear stories about alcohol abuses that have led to serious injury and or death, as well as sexual assault. People pour themselves drinks without knowing the amount of actual alcohol being poured. This leads to unhealthy and dangerous alcohol levels which results in drunk driving, alcohol poisoning, poor judgment, sexual assault, and often dangerous consequences.

SUMMARY

The foregoing paragraphs have been provided by way of general introduction, and are not intended to limit the scope of the following claims. The described embodiments, together with further advantages, will be best understood by reference to the following detailed description taken in conjunction with the accompanying drawings.

According to embodiments of the disclosed subject matter, a container for liquid includes a tumbler, wherein the tumbler includes a plurality of visual aids. Additionally, the container includes a lid detachably secured to the tumbler, wherein the lid includes a swing arm flap configured to be secured in an open or closed position, and an opening in a body of the lid configured to receive a portion of the swing arm flap in the closed position to seal the opening in the body of the lid.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
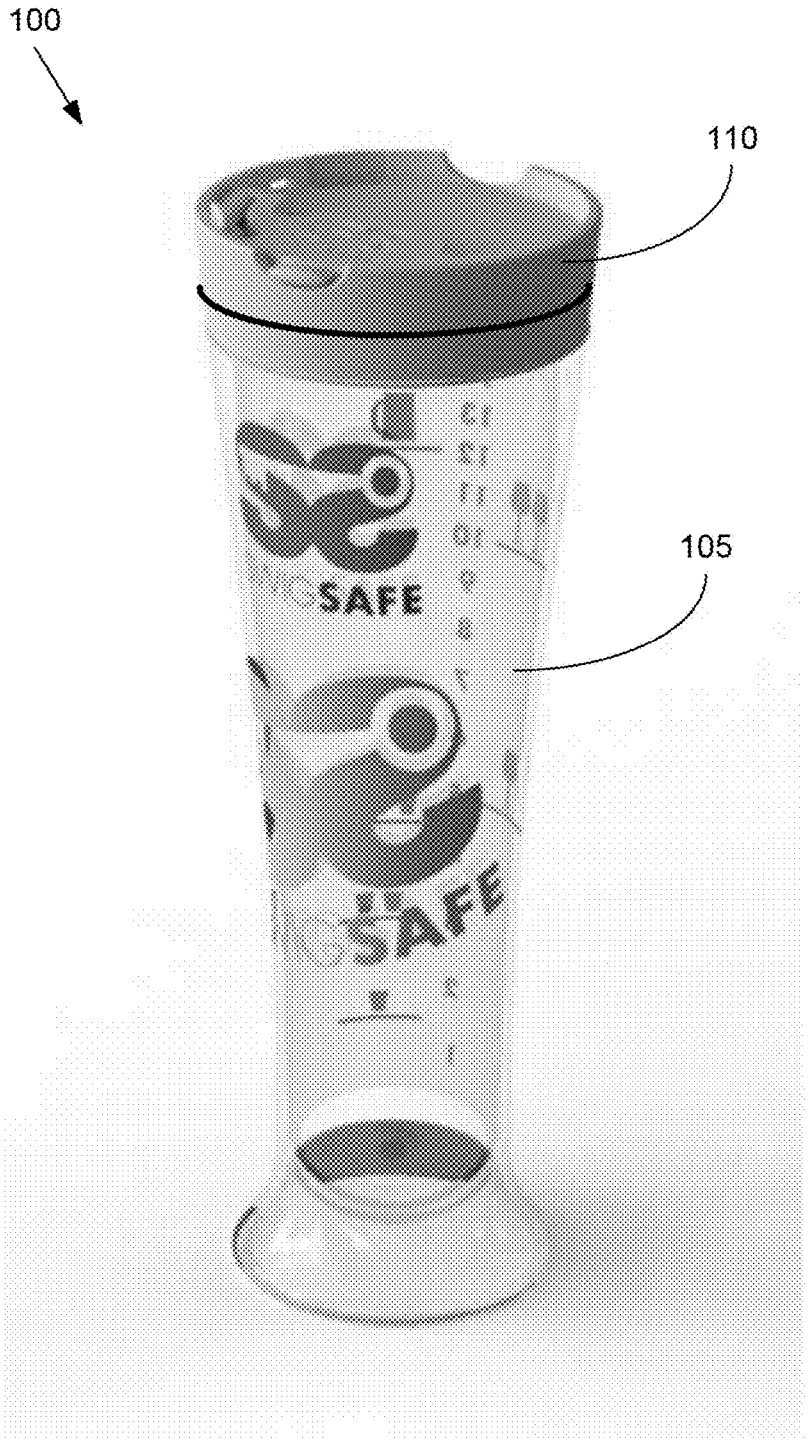
FIG. 1 is an exemplary perspective view of a container for liquid according to one or more aspects of the disclosed invention.

The description set forth below in connection with the appended drawings is intended as a description of various embodiments of the disclosed subject matter and is not necessarily intended to represent the only embodiment(s). In certain instances, the description includes specific details for the purpose of providing an understanding of the disclosed subject matter. However, it will be apparent to those skilled in the art that embodiments may be practiced without these specific details. In some instances, well-known structures and components may be shown in block diagram form in order to avoid obscuring the concepts of the disclosed subject matter.

Reference throughout the specification to "one embodiment" or "an embodiment" means that a particular feature, structure, characteristic, operation, or function described in connection with an embodiment is included in at least one embodiment of the disclosed subject matter. Thus, any appearance of the phrases "in one embodiment" or "in an embodiment" in the specification is not necessarily referring to the same embodiment. Further, the particular features, structures, characteristics, operations, or functions may be combined in any suitable manner in one or more embodiments. Further, it is intended that embodiments of the disclosed subject matter can and do cover modifications and variations of the described embodiments.

It must be noted that, as used in the specification and the appended claims, the singular forms "a," "an," and "the"

include plural referents unless the context clearly dictates otherwise. That is, unless clearly specified otherwise, as used herein the words "a" and "an" and the like carry the meaning of "one or more." Additionally, it is to be understood that terms such as "left," "right," "top," "bottom," "front," "rear," "side," "height," "length," "width," "upper," "lower," "interior," "exterior," "inner," "outer," and the like that may be used herein, merely describe points of reference and do not necessarily limit embodiments of the disclosed subject matter to any particular orientation or configuration. Furthermore, terms such as "first," "second," "third," etc., merely identify one of a number of portions, components, points of reference, operations and/or functions as described herein, and likewise do not necessarily limit embodiments of the disclosed subject matter to any particular configuration or orientation.

Referring now to the drawings, wherein like reference numerals designate identical or corresponding parts throughout the several views.

FIG. 1 is an exemplary perspective view of a container 100 for liquid according to one or more aspects of the disclosed invention. The container 100 can include a tumbler 105 and a lid 110. The tumbler 105 can be a drinking container that does not have a handle or a stem, for example. In an embodiment, the container 100 can be used with alcohol to promote safe alcohol consumption based on various features further described herein. Generally speaking, the container 100 can provide a visual verification (e.g., via the tumbler 105) of an amount of liquid (e.g., alcohol) placed in the container 100, as well as an amount of liquid being removed from the container 100 (e.g., via consuming the liquid). Additionally, the container 100 can provide the ability to carry the container 100 while the lid 110 is secured. The lid 110 can be detachably secured to the tumbler 110, for example. Further, the lid 110 can include an opening to drink from, as well as a swing arm flap to detachably secure (e.g., cover and/or seal) the opening in the lid 110 while not in use. Based on the lid 110 being secured to the tumbler 105 and the opening in the lid being secured via the swing arm flap, any liquid in the container 100 can be prevented from spilling, as well as preventing anything from entering the container 100 without the user's knowledge (e.g., dust, drugs, more liquid, etc.). In other words, a user can easily drink from the container 100 via the opening in the lid 110 while also easily securing the liquid in the container 100 (and preventing anything from entering the container 100) when not in use.

Additionally, the tumbler 105 can include visual aids. The visual aids can include ounce markers from 1 to 16 ounces and icons depicting 1, 2, and 3 shots, 1 and 2 glasses of wine or 1 bottle of beer, for example. The visual aids can assist a user in measuring precisely the amount of liquid entering the container 100. In an embodiment, the tumbler 105 can be transparent, which can allow for easier measurements by comparing the level of the liquid in the container 100 with the visual aids marked on the tumbler 105. Additionally, the transparent tumbler 105 can allow a user to see the type of liquid in the container 100 (e.g., color, viscosity, carbonation, bubbling, particles in the liquid, etc.) which can provide information for further determining if the liquid in the container 100 is as a user expects. Additionally, the container 100 can defend against an unfortunately common issue of the rise of drinks being spiked with drugs, for example. In addition to the tumbler 105 being clear and see-through, the lid 110 can be designed to be securely closed, which may assist in preventing drugs and/or anything unwanted from entering the container 100 without a user's knowledge. The lid can include the swing arm flap and wide drinking opening which can allow for easy to drink and easy to close functionality. The rise of spiked drinks on college campuses and in bars is steadily climbing, and the container 100 can allows a user to feel more in control as it is nearly impossible to watch a drink every moment. Further security can be included via a lanyard/carry strap that can be secured to a wrist of the user which can reduce the need to set the container 100 down and/or lose track of the container 100. A carry strap attachment portion can be positioned in a predetermined location on each side of the lid 110 so that a user can secure the strap to a right or left hand with equal comfort. In other words, the tumbler 105 can be leak proof via the lid 110 and easy to carry and hold with the carry strap which can allow a user to keep their container 100 with them with very limited hassle and inconvenience. If a user's drink is always with them, it may limit unwanted access to the container 100 providing an overall safer experience.

Additionally, one or more charms can be attached to the carry strap to be personalized and easily identifiable by the user. Because the charms may help distinguish between different containers 100, the charms may prevent any mix up of which container belongs to which user, thereby avoiding problems of those with allergies or transference of germs and diseases, for example.

The shape of the tumbler 105 can be a predetermined shape. The predetermined shape can be configured to provide the feeling of carrying a container made from glass rather than a typical water bottle. For example, the tumbler 105 can have a predetermined diameter on a first end of the tumbler 105 to which the lid 110 is attached, and the diameter can gradually decrease toward a second end of the tumbler opposite the first end with the diameter increasing again at the second end of the tumbler 105 such that the second end of the tumbler 105 flares out to create a stable base for the tumbler 105. The tumbler 105 can be constructed of Eastman Tritan Plastic, for example, which can be shatter proof, safe to use with a dishwasher, and safe for liquid usage.

Figure 2:
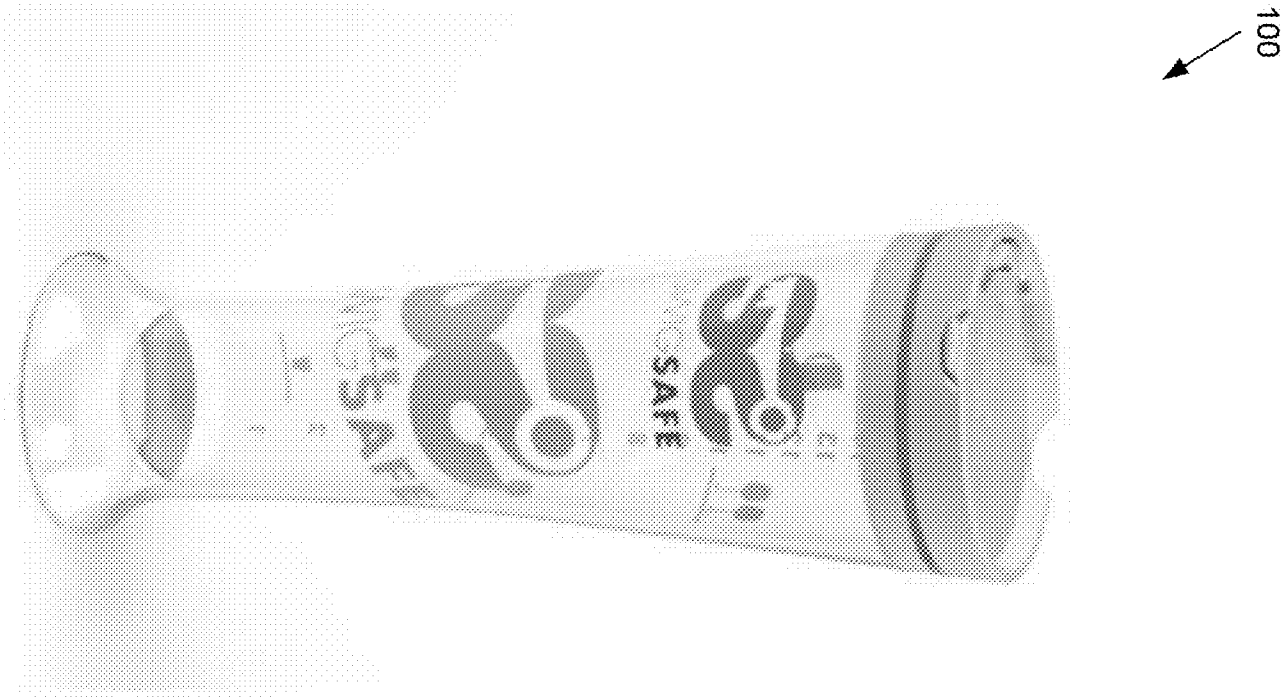
FIG. 2 depicts an exemplary perspective view of a container according to one or more aspects of the disclosed subject matter.

FIG. 2 depicts an exemplary perspective view of the container 100 according to one or more aspects of the disclosed subject matter. The container 100 can include a lid (e.g., lid 110) and a tumbler (e.g., tumbler 105).

Figure 3:
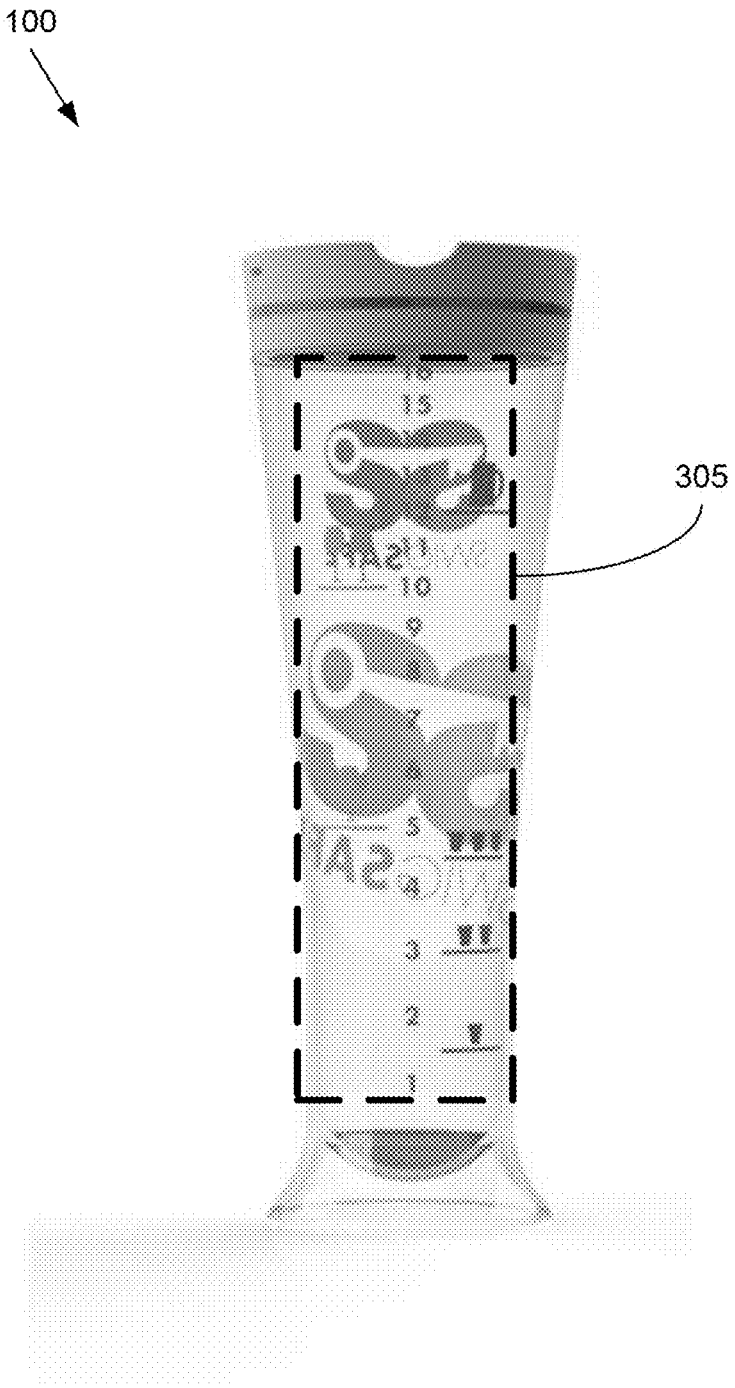
FIG. 3 depicts an exemplary a side view of a container according to one or more aspects of the disclosed subject matter.

FIG. 3 depicts an exemplary a side view of the container 100 according to one or more aspects of the disclosed subject matter. The tumbler 105 can include visual aids 305, wherein the visual aids 305 can include ounce markers from 1 to 16 ounces and icons depicting 1, 2, and 3 shots, 1 and 2 glasses of wine or 1 bottle of beer, for example. The visual aids 305 can assist a user in measuring precisely the amount of liquid entering the container 100. The tumbler 105 can be transparent so the user can clearly compare any liquid in the container 100 with the visual aids 305 to perform an easy, quick, and precise measurement of the amount of the liquid in the container 100.

Figure 4:
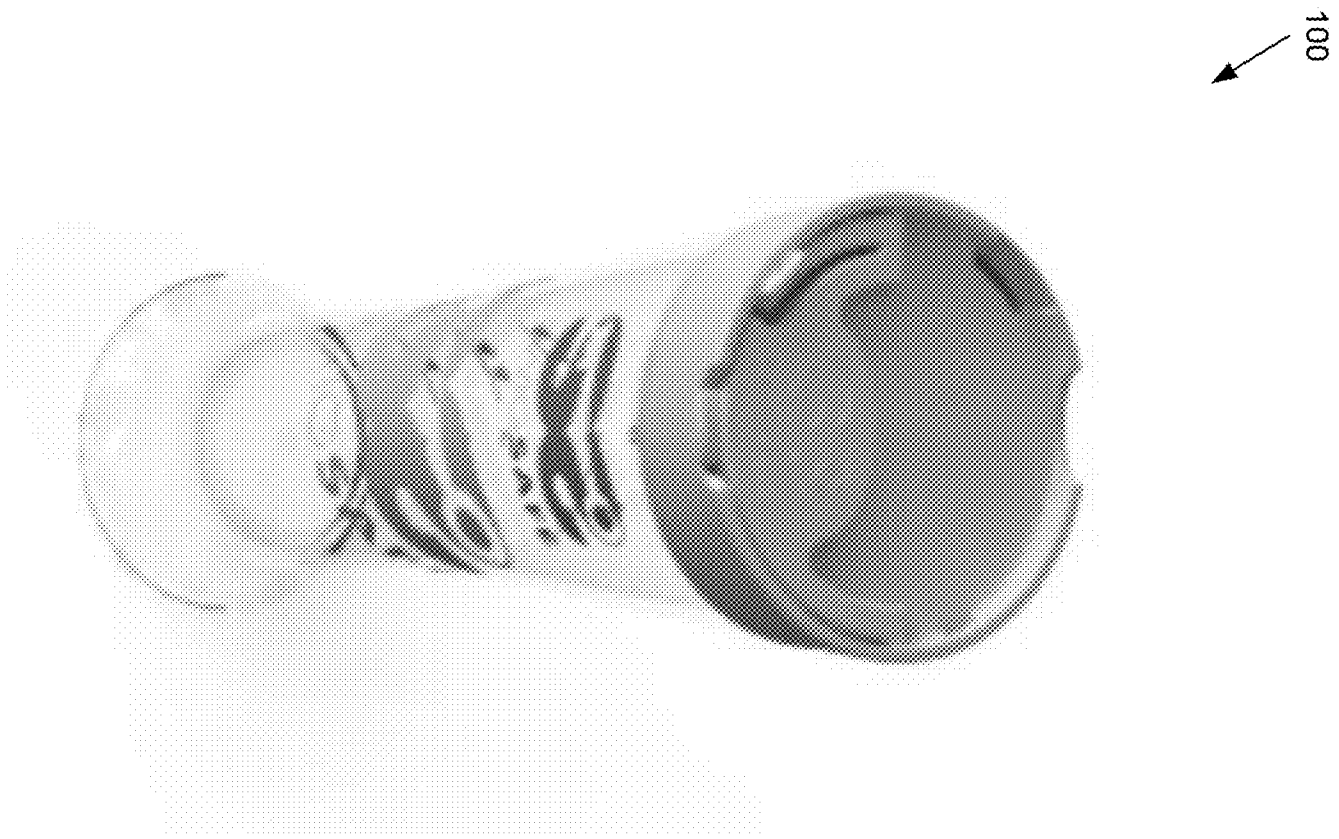
FIG. 4 depicts an exemplary aerial view of a container according to one or more aspects of the disclosed subject matter.

FIG. 4 depicts an exemplary aerial view of the container 100 according to one or more aspects of the disclosed subject matter.

Figure 5:
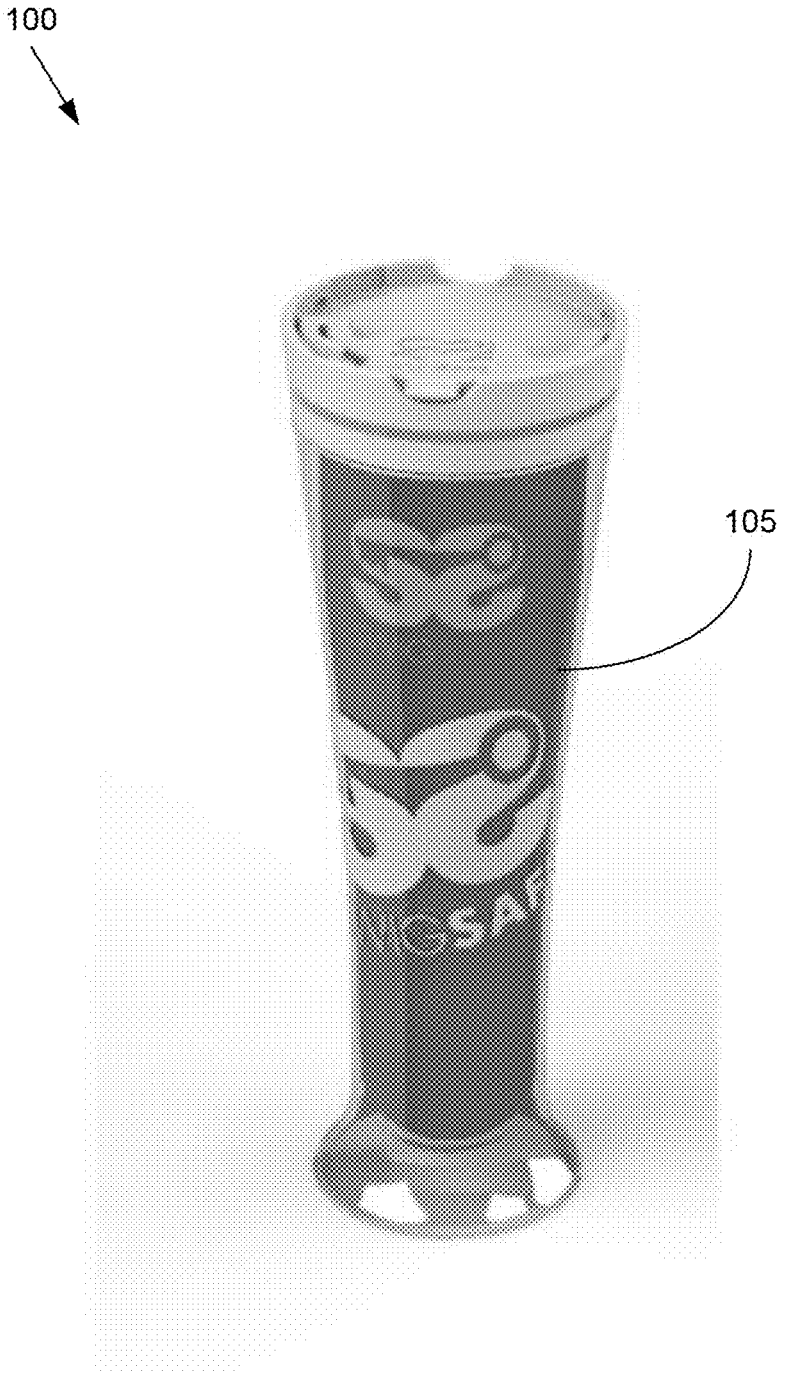
FIG. 5 depicts an exemplary perspective view of a container according to one or more aspects of the disclosed subject matter.

FIG. 5 depicts an exemplary perspective view of the container 100 according to one or more aspects of the disclosed subject matter. It should be appreciated that the darker color of the container 100 is simply to highlight the markings (e.g., visual aids and logos) on the tumbler 105. Additionally, the container 100 displayed in FIG. 5 may be analogous to how the markings may appear when the container 100 includes liquid (e.g., beer, wine, etc.). Therefore, the markings on the tumbler 110 may be even more obvious to a user when the container 100 is in use, for example.

Figure 6C:
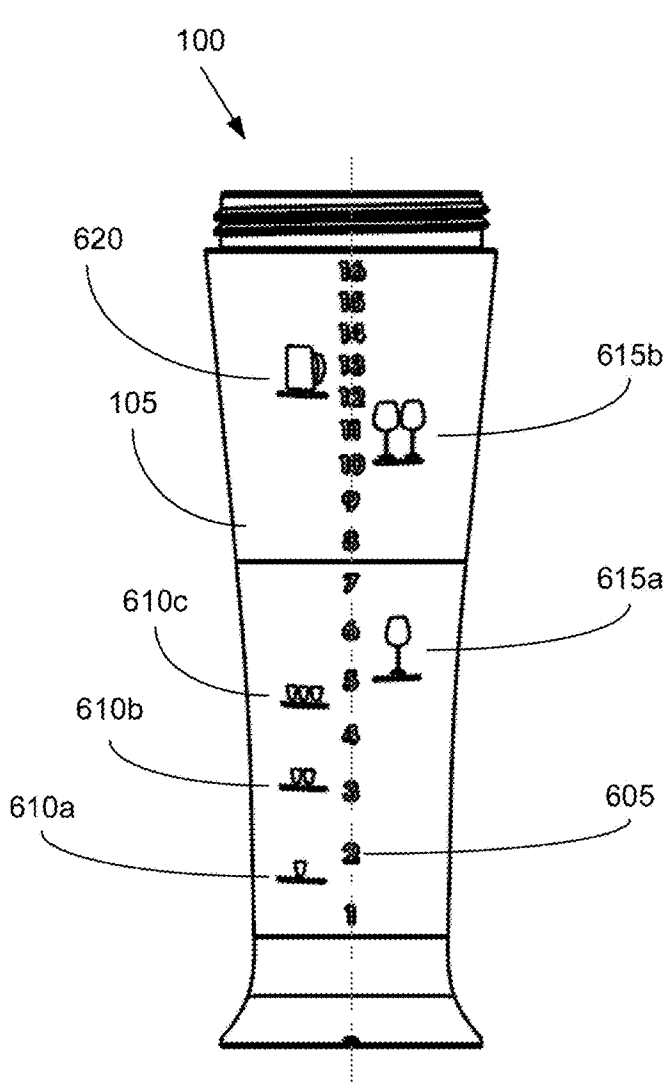
FIG. 6C depicts an exemplary side view of the container according to one or more aspects of the disclosed subject matter.
Figure 6B:
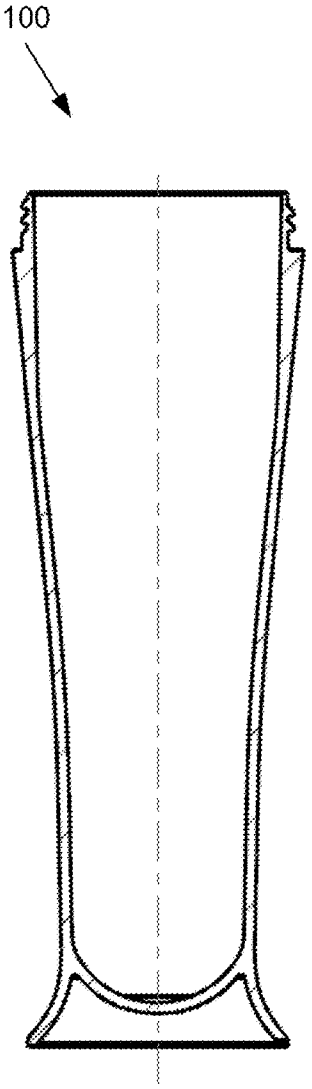
FIG. 6B depicts an exemplary side view of the container according to one or more aspects of the disclosed subject matter.
Figure 6A:
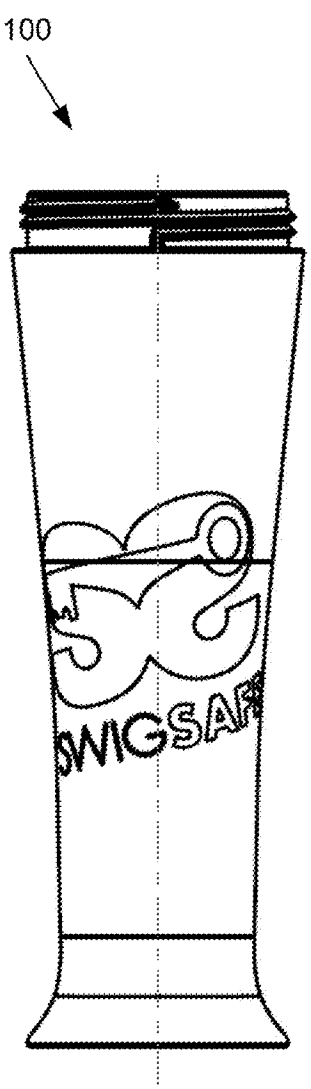
FIG. 6A depicts an exemplary side view of the container according to one or more aspects of the disclosed subject matter.

FIG. 6A depicts an exemplary side view of the container 100 according to one or more aspects of the disclosed subject matter.

FIG. 6B depicts an exemplary side view of the container 100 according to one or more aspects of the disclosed subject matter.

FIG. 6C depicts an exemplary side view of the container 100 according to one or more aspects of the disclosed subject matter. Each of the visual aids on the tumbler 105 can be located in a predetermined position. The predetermined position of each visual aid can correspond to an amount of liquid (e.g., via ounce markers), as well as an amount of a predetermined liquid (e.g., liquor, wine, and beer). More specifically, the tumbler 105 can include ounce markers 605, wherein the ounce markers 605 can mark from 1-16 ounces of liquid in the tumbler 105. The tumbler 105 can also include icons depicting 1, 2, and 3 shots corresponding to 610*a*, 610*b*, and 610*c*, respectively. The tumbler 105 can include icons depicting 1 and 2 glasses of wine corresponding to 615*a* and 615*b*, respectively. The tumbler 105 can include an icon depicting 1 bottle of beer corresponding to 620. The icons corresponding to 610*a-c*, 615*a-b*, and 620 can indicate what the amount of liquid corresponds to. For example, if wine is being poured from a bottle, a user could quickly and easily identify how much wine enters the container 100 because the icons of 1 and 2 wine glasses (e.g., 615*a*, 615*b*) indicate the amount of liquid corresponding to one glass or two glasses, respectively.

Figure 6D:
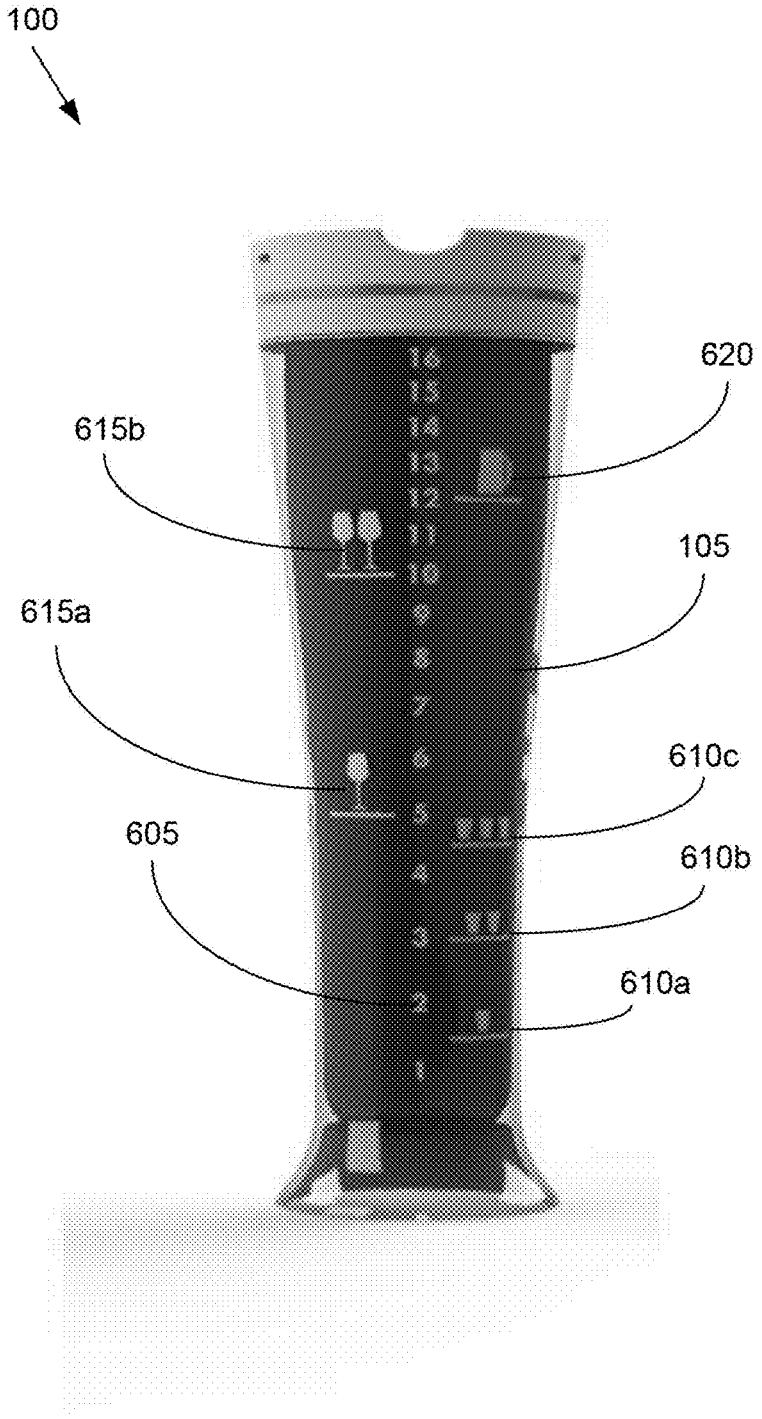
FIG. 6D depicts an exemplary side view of a container according to one or more aspects of the disclosed subject matter.

FIG. 6D depicts an exemplary side view of the container 100 according to one or more aspects of the disclosed subject matter. The tumbler 105 has been given a darker color simply to highlight the visual aids (e.g., ounce markers and icons) for reference in this figure. FIG. 6D includes the same visual aids as described in FIG. 6C. However, in one embodiment, the icons 615*a* and 615*b* can be on an opposite side of the ounce markers 605 relative to FIG. 6C. Similarly, icons 610*a*, 610*b*, 610*c*, and 620 can be on an opposite of the ounce markers 605 relative to FIG. 6C.

Figure 7:
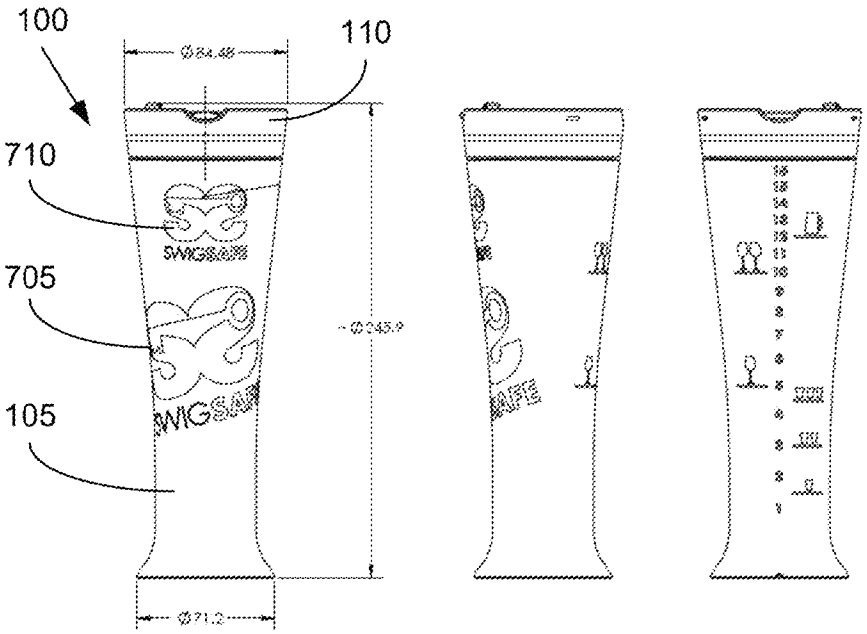
FIG. 7 depicts an exemplary assembly of a container according to one or more aspects of the disclosed subject matter.

FIG. 7 depicts an exemplary assembly of the container 100 according to one or more aspects of the disclosed subject matter. For example, FIG. 7 depicts a front view, side view, and rear view of the container 100. The front view may correspond to a side of the tumbler 105 including one or more logos 705, 710. Additionally, on an initial assembly, the lid 110 may be secured to the tumbler 105 such that a predetermined portion of the lid 110 aligns with the logo 710 on the tumbler 105. The side view of the tumbler 105 may include portions of the logos 705, 710, and portions of the visual aids on the rear of the tumbler 105. The rear of the tumbler 105 can be on a side of the tumbler 105 opposite the logos 705, 710, for example.

Figure 8:
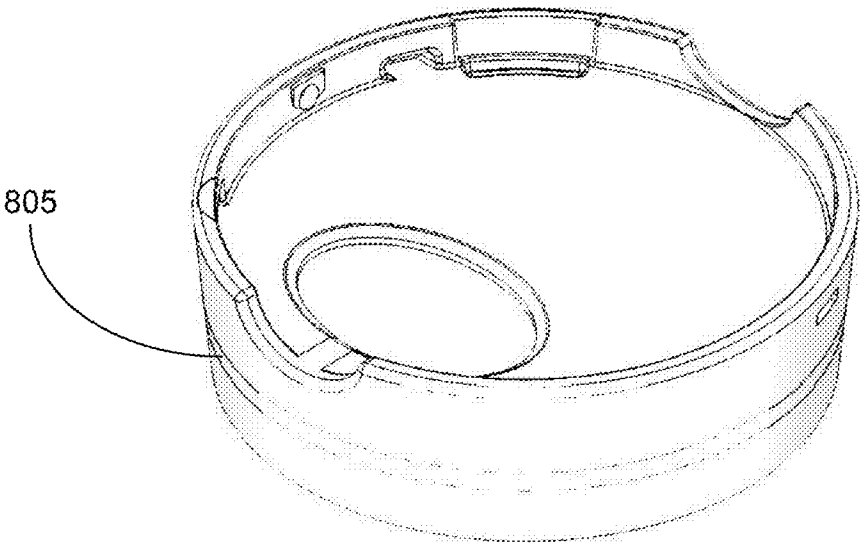
FIG. 8 depicts an exemplary lid body according to one or more aspects of the disclosed subject matter.

FIG. 8 depicts an exemplary lid body 805 according to one or more aspects of the disclosed subject matter. The lid body 805 can be a portion of the lid 110.

Figure 9:
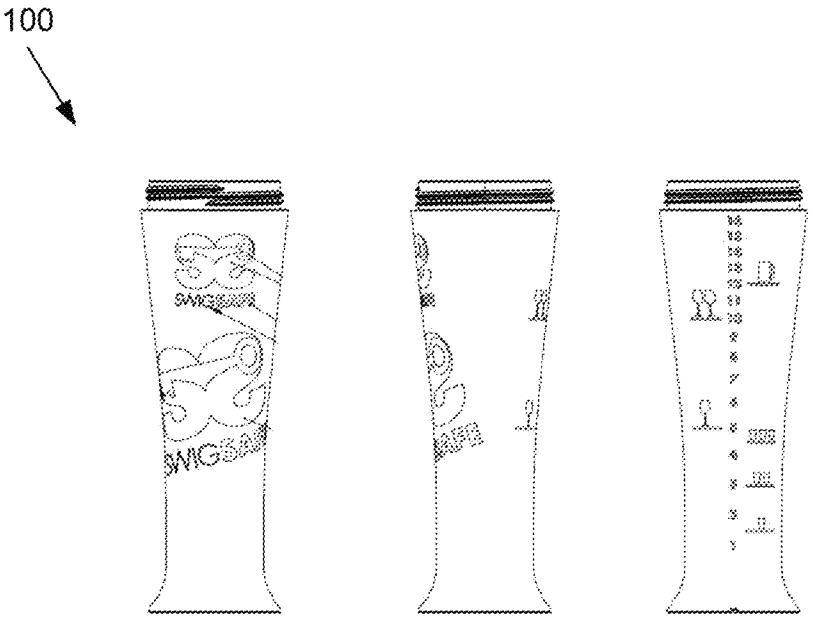
FIG. 9 depicts deboss and printing detail of a container according to one or more aspects of the disclosed subject matter.

FIG. 9 depicts deboss and printing detail of the container 100 according to one or more aspects of the disclosed subject matter.

Figure 10A:
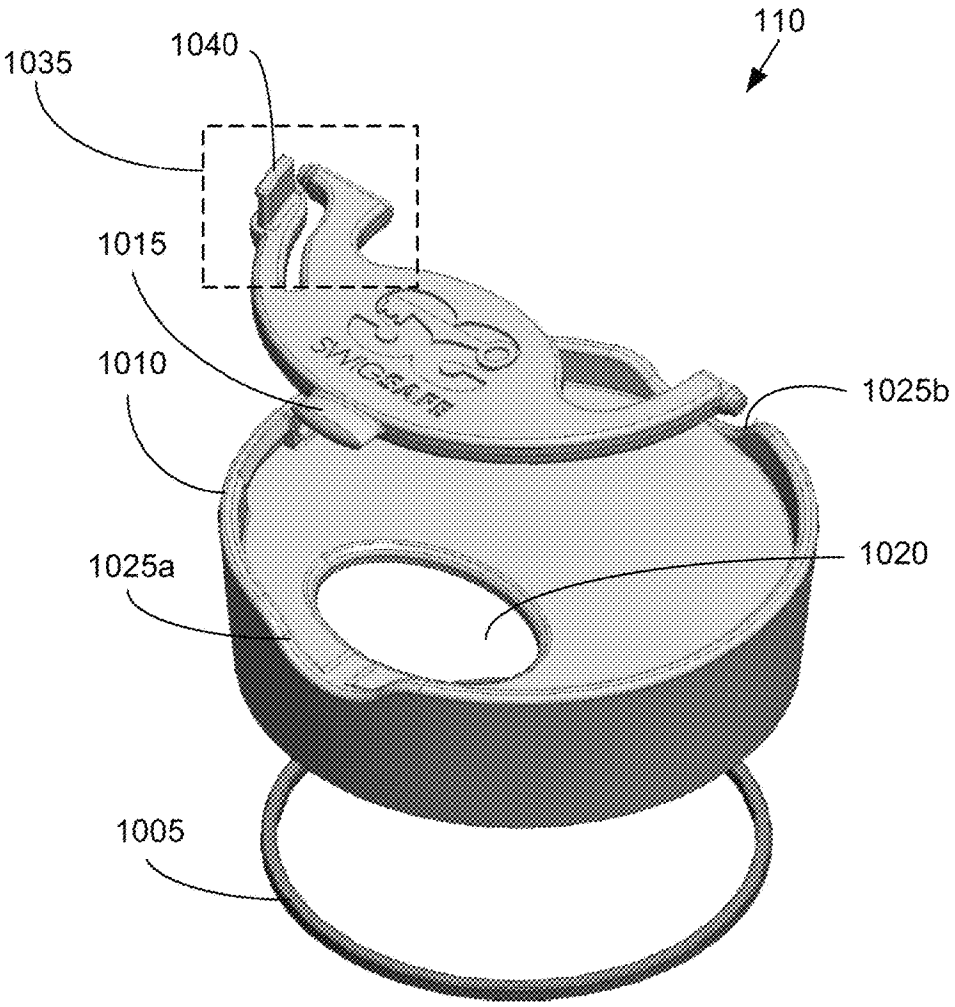
FIG. 10A depicts an assembly of the lid according to one or more aspects of the disclosed invention.
Figure 10A:
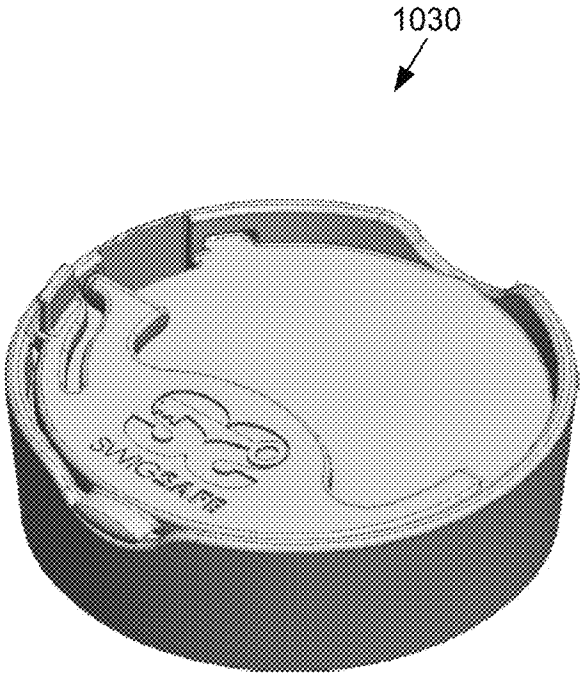

FIG. 10A depicts an assembly of the lid 110 according to one or more aspects of the disclosed invention. The lid 110 can include an O-ring 1005, a lid body 1010, and a swing arm flap 1015. The O-ring 1005 can assist in sealing the lid 110 to the tumbler 105, for example. In one embodiment, the O-ring 1005 is square. The lid body 1010 can include an opening 1020 through which a user can drink from the container 100, for example. The swing arm flap 1015 can be configured to cover and seal the opening 1020 to prevent leaks and spills, as well as prevent anything unwanted from entering the container 100 without the user's knowledge. The lid body 1010 can also include two swing arm flap securing portions 1025*a*, 1025*b*. A first swing arm flap securing portion 1025*a* can secure the swing arm flap 1015 in a closed position which can assist in preventing leaks and spills, as well as preventing anything unwanted from entering the container 100 without the user's knowledge. A second swing arm flap securing portion 1025*b* can secure the swing arm flap 1015 in an fully open position so that a user can drink from the container 100, for example, while the swing arm flap 1015 is secured and not moving freely when the user tilts the container 100 toward themselves to drink from the container 100. The swing arm flap 1015 can be seen in a securely closed position in the lid assembly 1030, for example. Additionally, the swing arm flap can include a locking mechanism 1035, and the locking mechanism 1035 can include a tab 1040. The locking mechanism 1035 can assist in maintaining a spill proof lid 110. Additionally, the locking mechanism 1035 can secure the lid so that only the user of the container 100 controls what goes into the container 100. In one embodiment, the tab 1040 can be interacted with to place the swing arm flap in an unlocked position. For example, pressure can placed on the tab 1040 (e.g., toward a center of the lid 110) which frees the swing arm flap. Additionally, pressure can be placed on the tab 1040 (e.g., away from the center of the lid 110) to lock the swing arm flap.

Figure 10B:
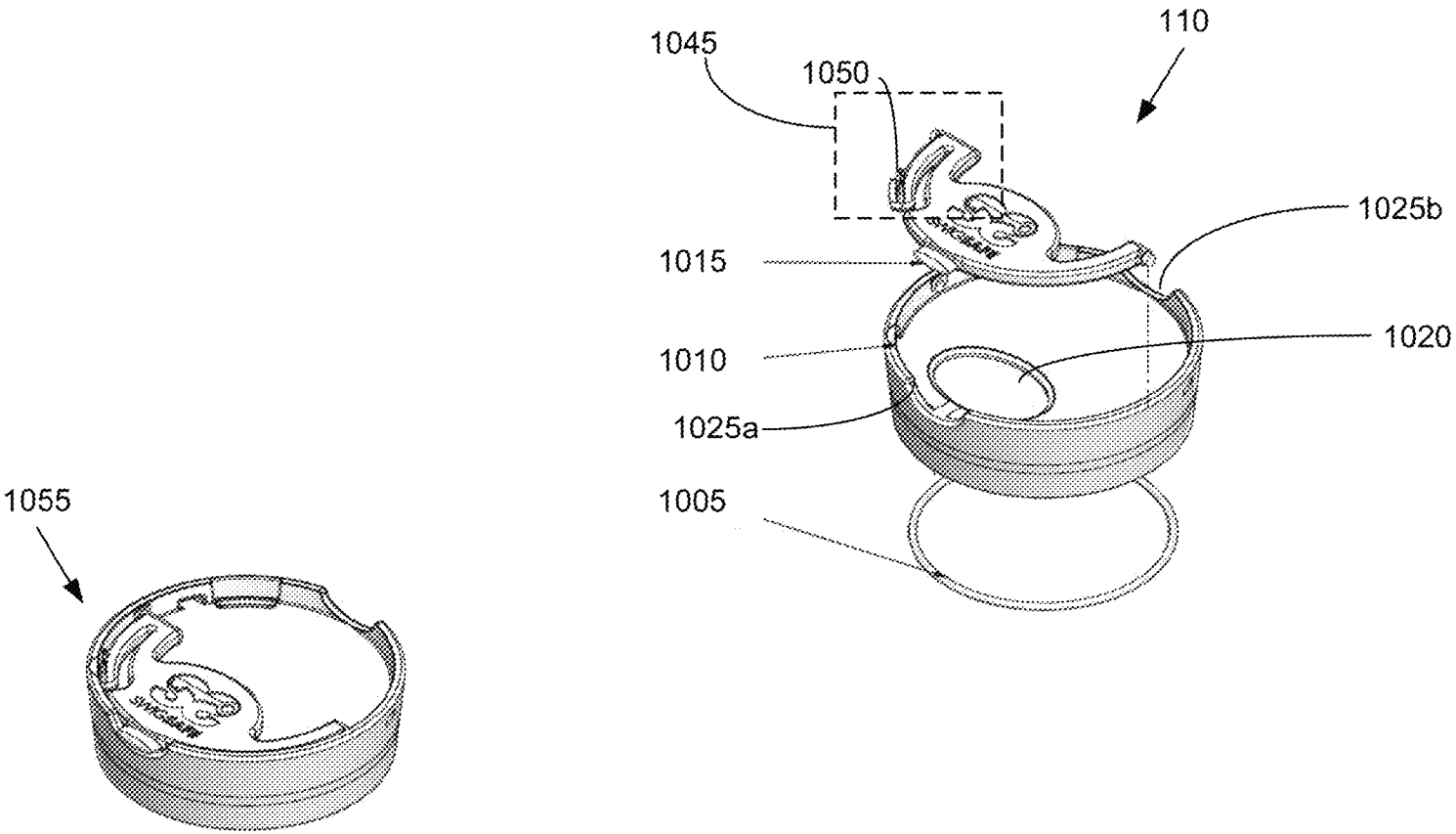
FIG. 10B depicts an assembly of a lid according to one or more aspects of the disclosed invention.

FIG. 10B depicts an assembly of the lid 110 according to one or more aspects of the disclosed invention. FIG. 10B can include the same components as described in FIG. 10A. However, in one embodiment, the O-ring can be circular rather than square. Additionally, in one embodiment, a locking mechanism 1045 can be positioned so that a tab 1050 and a cutout of the locking mechanism 1045 are oriented in a position opposite relative the locking mechanism 1035 and tab 1040 in FIG. 10A. Additionally, the swing arm flap 1015 can be seen in a closed position in the lid assembly 1055.

Figure 11:
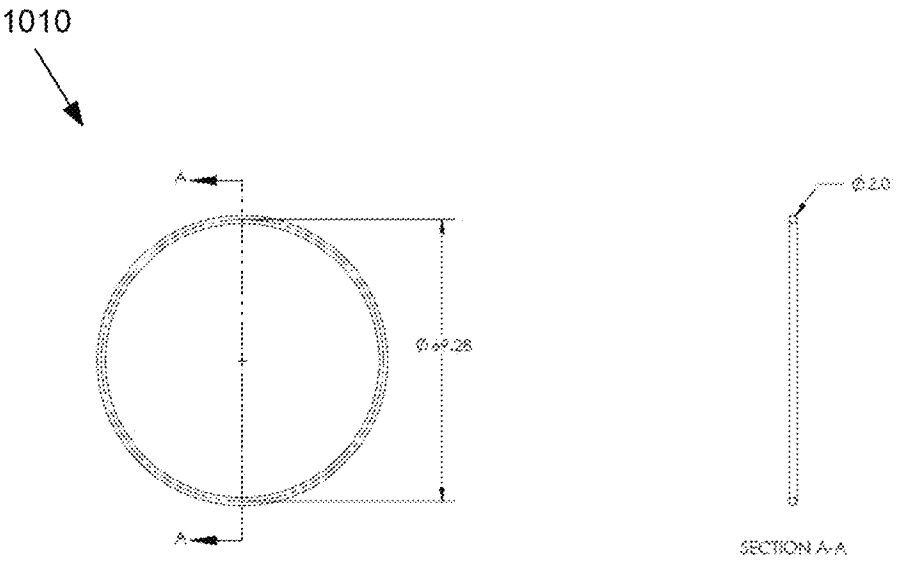
FIG. 11 depicts exemplary O-ring dimensions according to one or more aspects of the disclosed subject matter.

FIG. 11 depicts exemplary O-ring dimensions according to one or more aspects of the disclosed subject matter. The O-ring 1010 can have a predetermined diameter, for example.

Figure 12:
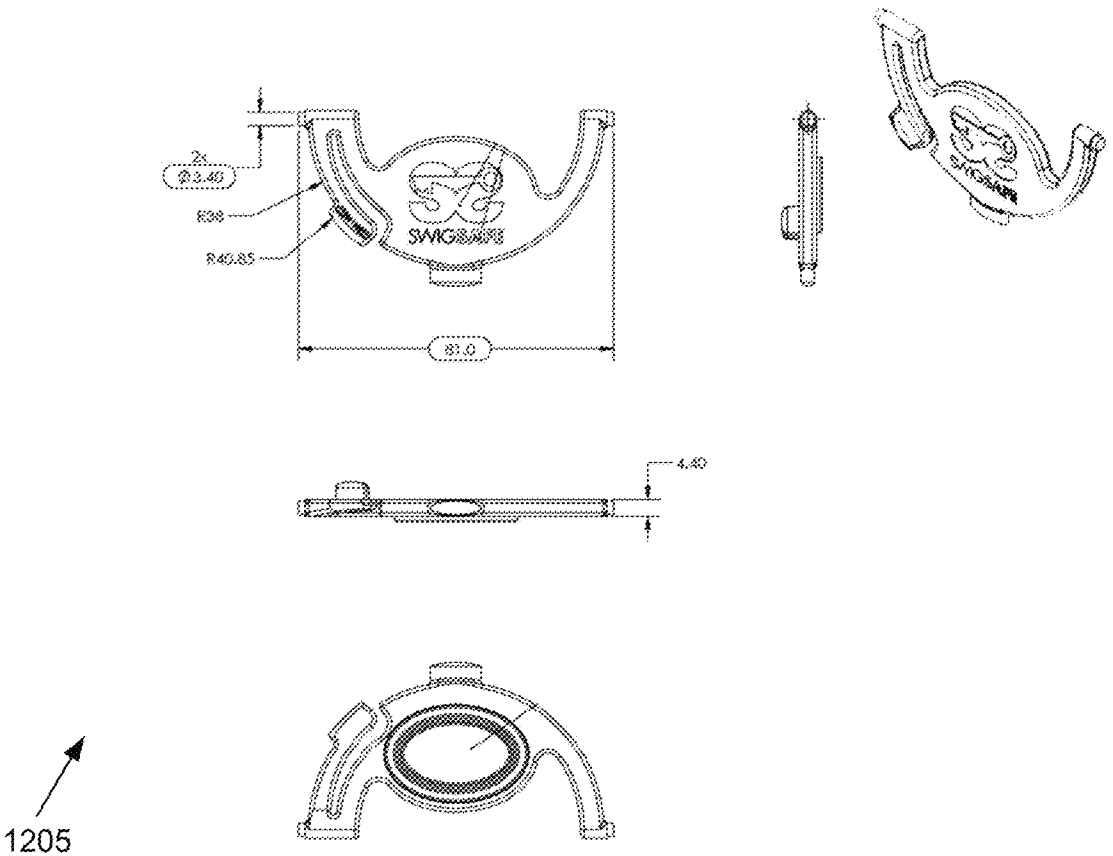
FIG. 12 depicts an exemplary swing arm flap body according to one or more aspects of the disclosed subject matter.

FIG. 12 depicts an exemplary swing arm flap body 1205 according to one or more aspects of the disclosed subject matter.

Figure 13:
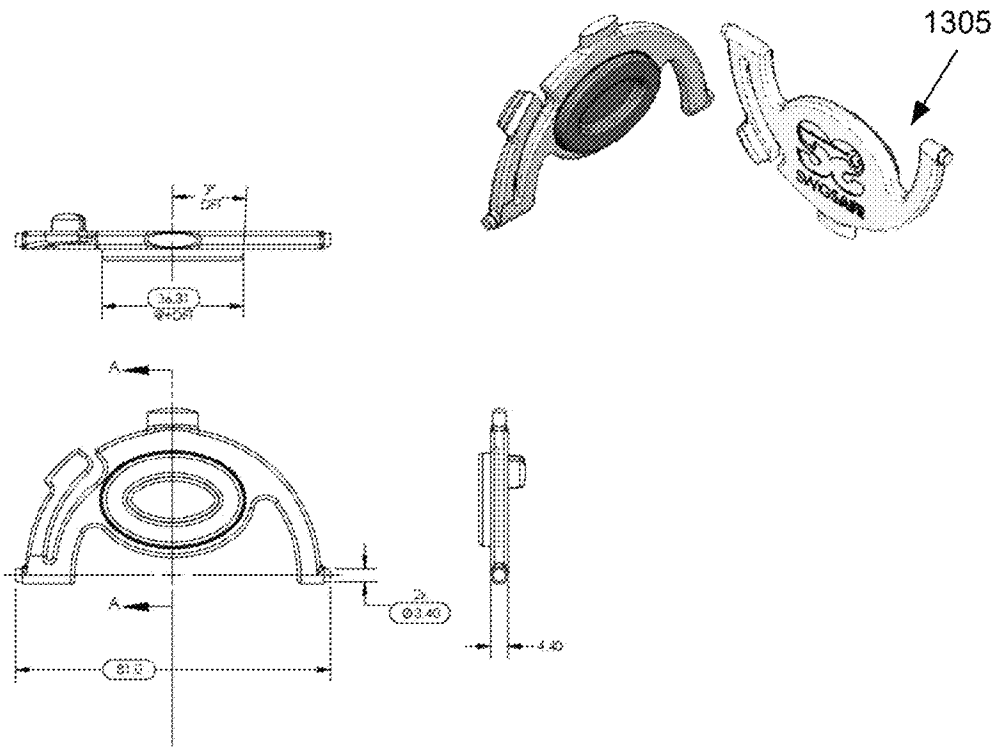
FIG. 13 depicts an exemplary swing arm flap with over mold according to one or more aspects of the disclosed subject matter.

FIG. 13 depicts an exemplary swing arm flap with over mold 1305 according to one or more aspects of the disclosed subject matter.

Figure 14:
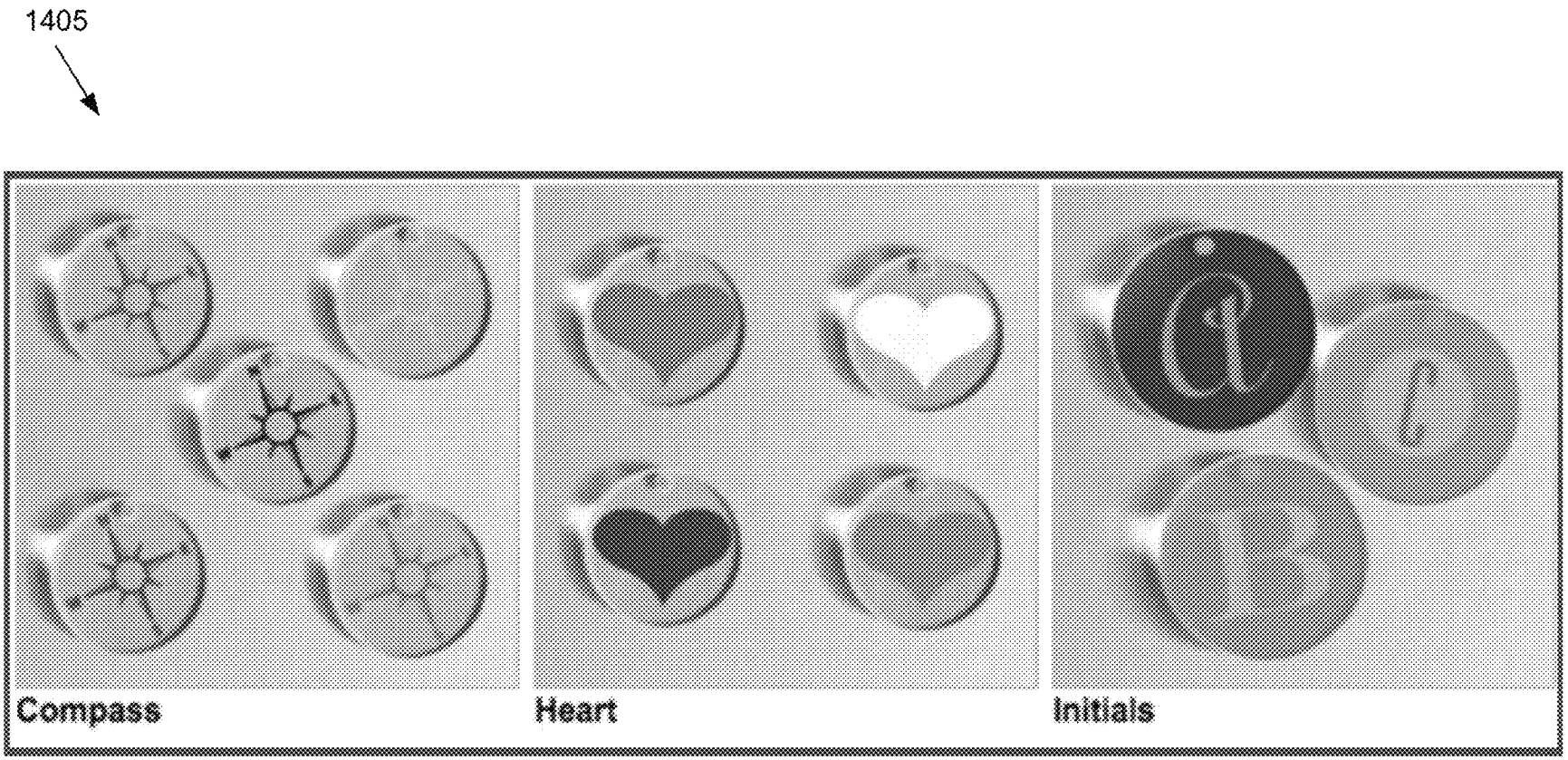
FIG. 14 depicts exemplary charms according to one or more aspects of the disclosed subject matter.

FIG. 14 depicts exemplary charms 1405 according to one or more aspects of the disclosed subject matter. One or more charms can be secured to the container 100. For example, the charms can be secured to the carry strap, and the carry strap can be secured to the container 100. Additionally, adding one or more charms to the container 100 can cause the container 100 to be easily identified by a user to prevent the container 100 from being lost or confused with another user's container, for example.

Figure 15:
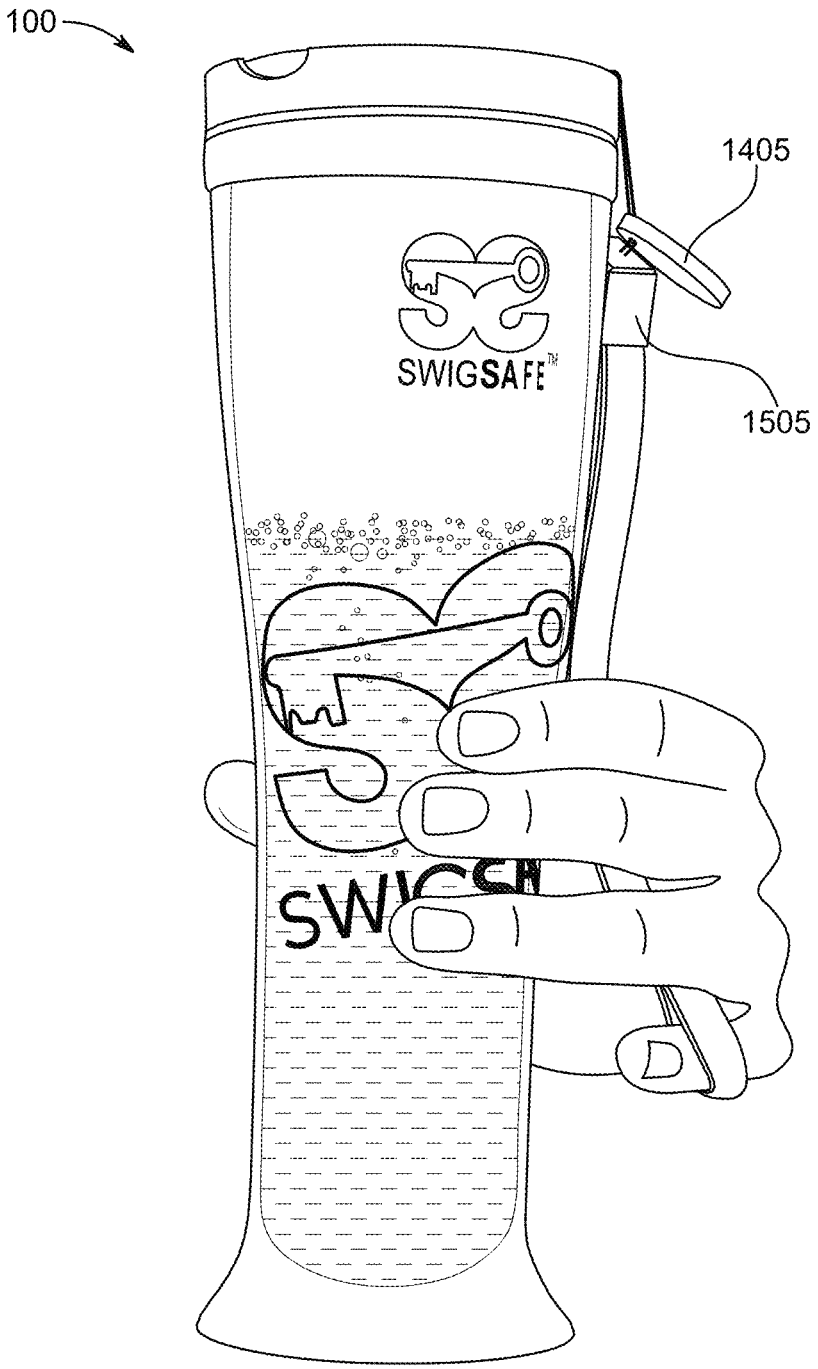
FIG. 15 depicts an exemplary carry strap attached to a container according to one or more aspects of the disclosed subject matter.

FIG. 15 depicts an exemplary carry strap 1505 attached to a container according to one or more aspects of the disclosed subject matter. Additionally, one or more of the charms 1405 can be secured to the carry strap 1505, thereby securing the charm to the container 100, for example.

The container 100 includes various advantages including improved safety via the various features described herein.

For example, the highly visible ounces markers and numbers, as well as the icons depicting shot glasses, wine glasses and beer bottle in a clear tumbler can significantly assist a user in knowing and easily calculating how much liquid (e.g., alcohol) is entering and/or being removed (e.g., consuming) from the container 100. For example, icon 610*a* can be used to measure one shot glass of liquor, icon 615*a* can be used to measure one glass of wine, icon 620 can be used to measure a glass of beer, and the like. Additionally, the design of the lid 110 can be secure and tamper resistant to reduce the potential for any unwanted items (e.g., drugs, dust, debris, etc.) from entering the container 100 without the user's knowledge. Further, the carry strap can assist the user in keeping the container 100 in the user's possession at all times (e.g., the user may be less likely to set the container 100 down and leave it unattended). Another advantage includes the container 100 having a predetermined shape. For example, the shape of the container can be designed visually and structurally to resemble a drinking glass rather than a water bottle. The addition of the charm(s) can provide customization and personalization opportunities while significantly increasing the ease of identification of the container 100 to prevent losing or confusing a user's container with another container. As a result, the container 100 can improve overall safety of a user via the various features described herein while consuming alcohol, for example.

Having now described embodiments of the disclosed subject matter, it should be apparent to those skilled in the art that the foregoing is merely illustrative and not limiting, having been presented by way of example only. Thus, although particular configurations have been discussed herein, other configurations can also be employed. Numerous modifications and other embodiments (e.g., combinations, rearrangements, etc.) are enabled by the present disclosure and are within the scope of one of ordinary skill in the art and are contemplated as falling within the scope of the disclosed subject matter and any equivalents thereto. Features of the disclosed embodiments can be combined, rearranged, omitted, etc., within the scope of the invention to produce additional embodiments. Furthermore, certain features may sometimes be used to advantage without a corresponding use of other features. Accordingly, Applicant(s) intend(s) to embrace all such alternatives, modifications, equivalents, and variations that are within the spirit and scope of the disclosed subject matter.

The invention claimed is:

1. An apparatus, comprising:

a tumbler, wherein the tumbler includes a plurality of visual aids; and a lid detachably secured to the tumbler, wherein the lid includes a lid body including an opening and a raised edge extending around a perimeter of the lid body to surround the opening, the raised edge including a first depression that forms a first swing arm flap securing portion, and a swing arm flap configured to be secured in an open or closed position, the swing arm flap being a planar body that includes tabs extending along a rotation axis in opposite directions, the tabs being rotatably received in the raised edge of the lid body such that the lid body can rotate around the rotation axis, wherein, when the swing arm flap is in the closed position, a portion of the swing arm flap is positioned in the first depression that forms the first swing arm flap securing portion to seal the opening in the body of the lid, wherein the lid includes a locking mechanism and the locking mechanism includes an arm extending out from the swing arm flap and a locking tab, the arm and the locking tab being configured to lock the swing arm flap in a closed position in response to pressure being applied to the tab in a first direction away from a center of the lid, wherein the arm and the swing arm flap are co-planar, the tab extends upward from the arm such that a top of the tab is positioned above the raised edge of the lid body when the swing arm flap is in the closed position, and the locking mechanism is configured to be unlocked in response to pressure being applied to the tab in a second direction toward the center of the lid, and wherein the arm of the locking mechanism extends out from the swing arm flap such that a gap exists between the arm and the swing arm flap, the locking mechanism is configured to be unlocked in response to pressure being applied to the tab in the second direction toward the center of the lid such that the arm moves towards the swing arm flap to close the gap.

2. The apparatus of claim 1, wherein the plurality of visual aids includes ounce markers.

3. The apparatus of claim 2, wherein the plurality of visual aids includes a first icon corresponding to one shot glass in a first predetermined position, a second icon corresponding to two shot glasses in a second predetermined position, and a third icon corresponding to three shot glasses in a third predetermined position, wherein each of the first, second, and third predetermined position is based on the ounce markers.

4. The apparatus of claim 3, wherein the first predetermined position is configured to measure one shot glass of liquor, the second predetermined position is configured to measure two shot glasses of liquor, and the third predetermined position is configured to measure three shot glasses of liquor.

5. The apparatus of claim 2, wherein the plurality of visual aids includes a fourth icon corresponding to one wine glass in a fourth predetermined position and a fifth icon corresponding to two wine glasses in a fifth predetermined position, wherein each of the fourth and fifth predetermined position is based on the ounce markers.

6. The apparatus of claim 5, wherein the fourth predetermined position is configured to measure one glass of wine, and the fifth predetermined position is configured to measure two glasses of wine.

7. The apparatus of claim 2, wherein the plurality of visual aids includes a sixth icon corresponding to a glass of beer in a sixth predetermined position, wherein the sixth predetermined position is based on the ounce markers.

8. The apparatus of claim 7, wherein the sixth predetermined position is configured to measure one beer.

9. The apparatus of claim 1, wherein the swing arm flap being in the closed and locked position corresponds to the apparatus being spill proof.

10. The apparatus of claim 1, wherein the lid includes a carry strap.

11. The apparatus of claim 10, wherein the carry strap includes one or more charms removeably attached.

12. The apparatus of claim 11, wherein the one or more charms are configured for identification of the apparatus.

13. The apparatus of claim 1, wherein the lid includes an O-ring.

14. The apparatus of claim 13, wherein the O-ring is rectangular.

15. The apparatus of claim 1, wherein the tumbler is configured to be transparent, wherein the transparency is configured to allow measurement of liquid entering and being removed from the tumbler.

16. The apparatus of claim 1, wherein the tumbler includes a flared base.

17. The apparatus of claim 1, wherein the raised edge of the lid body includes a second depression that forms a second swing arm flap securing portion such that, when the swing arm flap is in the open position, the portion of the swing aim flap is positioned in the second depression and the swing arm flap does not cover the opening in the body of the lid.

* * * * *